US006676829B1

(12) United States Patent
Angevine et al.

(10) Patent No.: US 6,676,829 B1
(45) Date of Patent: Jan. 13, 2004

(54) PROCESS FOR REMOVING SULFUR FROM A HYDROCARBON FEED

(75) Inventors: Philip J. Angevine, Woodbury, NJ (US); Anna B. Gorshteyn, Kirkwood Voorhees, NJ (US); Larry A. Green, Mickleton, NJ (US); Yuk Mui Louie, Springfield, PA (US); David A. Pappal, Haddonfield, NJ (US); Peter J. Owens, Mantua, NJ (US); Richard J. Quann, Morrestown, NJ (US); Jolie A. Rhinehart, Chester Spring, PA (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/456,851

(22) Filed: Dec. 8, 1999

(51) Int. Cl.[7] ..... C10G 45/04; C10G 65/04

(52) U.S. Cl. ..... 208/210; 208/211; 208/212; 208/89

(58) Field of Search ..... 208/210, 211, 208/212, 89

(56) References Cited

U.S. PATENT DOCUMENTS

| | | | | |
|---|---|---|---|---|
| 2,965,564 A | * | 12/1960 | Kirshenbaum et al. | 208/217 |
| 3,347,779 A | * | 10/1967 | Groenendaal et al. | 208/89 |
| 3,573,198 A | * | 3/1971 | Parker et al. | 208/89 |
| 3,592,758 A | | 7/1971 | Inwood | |
| 4,171,260 A | | 10/1979 | Farcasiu et al. | |
| 4,283,272 A | | 8/1981 | Garwood et al. | |
| 4,827,076 A | | 5/1989 | Kokayeff et al. | |
| 4,849,093 A | | 7/1989 | Vauk et al. | |
| 4,973,396 A | * | 11/1990 | Markley | 208/89 |
| 5,011,593 A | | 4/1991 | Ware et al. | |
| 5,041,208 A | | 8/1991 | Patridge et al. | |
| 5,110,444 A | | 5/1992 | Haun et al. | |
| 5,252,199 A | | 10/1993 | Singhal et al. | |
| 5,290,427 A | | 3/1994 | Fletcher et al. | |
| 5,318,690 A | | 6/1994 | Fletcher et al. | |
| 5,320,742 A | | 6/1994 | Fletcher et al. | |
| 5,346,609 A | | 9/1994 | Fletcher et al. | |
| 5,346,612 A | | 9/1994 | Kukes et al. | |
| 5,360,532 A | | 11/1994 | Fletcher et al. | |
| 5,401,391 A | | 3/1995 | Collins et al. | |
| 5,409,599 A | | 4/1995 | Harandi | 208/210 |
| 5,413,698 A | | 5/1995 | Fletcher et al. | |
| 5,482,617 A | | 1/1996 | Collins et al. | |
| 5,510,016 A | | 4/1996 | Hilbert et al. | |
| 5,520,799 A | | 5/1996 | Brown et al. | |
| 5,599,441 A | | 2/1997 | Collins et al. | |
| 5,611,914 A | | 3/1997 | Prince et al. | |
| 5,707,511 A | | 1/1998 | Markley et al. | |
| 5,741,414 A | * | 4/1998 | Waku et al. | 208/89 |
| 5,843,300 A | | 12/1998 | Zinnen et al. | |
| 5,925,239 A | * | 7/1999 | Klein et al. | 208/213 |
| 5,928,498 A | * | 7/1999 | McVicker et al. | 208/213 |
| 5,935,420 A | * | 8/1999 | Baird, Jr. et al. | 208/213 |
| 6,042,716 A | * | 3/2000 | Morel et al. | 208/89 |
| 6,103,106 A | * | 8/2000 | McVicker et al. | 208/213 |
| 6,217,748 B1 | * | 4/2001 | Hatanaka et al. | 208/210 |
| 6,296,759 B1 | * | 10/2001 | Vaarkamp et al. | 208/217 |

FOREIGN PATENT DOCUMENTS

| | | | | |
|---|---|---|---|---|
| WO | WO 9703150 A1 | * | 1/1997 | C10G/65/08 |
| WO | WO-98/35754 A | * | 8/1998 | |

* cited by examiner

*Primary Examiner*—Walter D. Griffin
(74) *Attorney, Agent, or Firm*—Malcolm D. Keen

(57) ABSTRACT

A method is provided for removing sulfur from an effluent produced by hydrotreating a hydrocarbon feed, said effluent having a heavy fraction containing polyaromatic sulfur compounds and a lighter fraction, said method comprising contacting the effluent with a noble metal containing hydrodearomatization catalyst on a support under superatmospheric hydrogen pressure and reaction conditions sufficient to hydrogenate at least one ring of said polyaromatic sulfur compounds and thereby produce a product with a reduced sulfur content.

8 Claims, 7 Drawing Sheets

PROCESS FOR REMOVING SULFUR FROM A HYDROCARBON FEED

BACKGROUND

Heavy petroleum fractions, such as vacuum gas oil or resides may be catalytically cracked to lighter and more valuable products. The product of catalytic cracking is conventionally recovered and the products fractionated into various fractions such as light gases; naphtha, including light and heavy gasoline; distillate fractions, such as heating oil and diesel fuel; lube fractions; and heavier fractions.

Generally, sulfur occurs in petroleum and petroleum products as hydrogen sulfide, organic sulfides, organic disulfides, mercaptans, also known as thiols, and aromatic ring compounds such as thiophene, benzothiophene (BT), dibenzothiophene (DBT) and their alkylated homologs. The sulfur in aromatic sulfur-containing ring compounds will be herein referred to as "thiophenic sulfur".

Where a petroleum fraction is being catalytically cracked and contains sulfur, the products of catalytic cracking usually contain sulfur impurities which normally require removal, usually by hydrotreating, in order to comply with the relevant product specifications. Such hydrotreating can be done either before or after catalytic cracking.

Conventionally, feeds with substantial amounts of sulfur, for example, those with more than 500 ppm sulfur, are hydrotreated with conventional hydrotreating catalysts under conventional conditions, thereby changing the form of most of the sulfur in the feed to hydrogen sulfide. The hydrogen sulfide is then removed by amine absorption, stripping or related techniques. Unfortunately, these techniques often leave some traces of sulfur in the feed, including thiophenic sulfur, which are the most difficult types to convert.

The ease of sulfur removal from petroleum and its products is dependent upon the type of sulfur-containing compound. Mercaptans are relatively easy to remove, whereas aromatic compounds such as thiophenes are more difficult to remove. Of the thiophenic sulfur compounds, the alkyl substituted dibenzothiophenes are particularly resistant to hydrodesulfurization.

Hydrotreating any of the sulfur containing fractions which boil in the distillate boiling range, such as diesel fuel, causes a reduction in the aromatic content thereof, and therefore an increase in the cetane number of diesel fuel. While hydrotreating reacts hydrogen with the sulfur containing molecules in order to convert the sulfur and remove such as hydrogen sulfide, as with any operation which reacts hydrogen with a petroleum fraction, the hydrogen does not only react with the sulfur as desired. Other contaminant molecules contain nitrogen, and these components undergo hydrodenitrogenation in a manner analogous to hydrodesulfurization. Unfortunately, some of the hydrogen may also cause hydrocracking as well as aromatic saturation, especially during more severe operating conditions of increased temperature and/or pressure. Typically, as the degree of desulfurization increases, the cetane number of the diesel fuel increases; however this increase is generally slight, usually from 1–3 numbers.

The current specification for diesel fuel permits a maximum sulfur content of 0.05 wt %. However, the EPA is expected to propose new diesel fuel specifications that will become effective in 2004. The new specification is likely to require further reduction of sulfur content in diesel fuels to below 50 ppmw. Recently, the European Union published new diesel specifications, which limit the sulfur content of diesel fuels to a maximum of 350 ppmw after the year 2000, and to 50 ppmw maximum after the year 2004. In addition, the specifications may require an increase in the cetane value of diesel fuels to 58 in the year 2005, and a reduction in the polyaromatics content.

Hydrotreating can be effective in reducing the level of sulfur to moderate levels, e.g. 500 ppm, without a severe degradation of the desired product. However, to achieve the levels of desulfurization that will be require by the new regulations, almost all sulfur compounds will need to be removed, even those that are difficult to remove such as DBTs. These refractory sulfur compounds can be removed by distillation, but with substantial economic penalty, i.e., downgrading a portion of automotive diesel oil to heavy fuel oil.

Thus, there remains a need for a method of removing sulfur from a hydrocarbon feed under moderate process conditions.

SUMMARY OF THE INVENTION

The present invention is a method for removing sulfur from an effluent produced by hydrotreating a hydrocarbon feed. A process is provided in which the sulfur remaining in the effluent from the hydrotreating process is removed by contacting the effluent with a noble metal containing hydrodearomatization (HDA) catalyst on a support under reaction conditions sufficient to hydrogenate at least one ring within the polyaromatic sulfur compounds. The hydrogenated DBTs are then desulfurized at a rate that is 10–50 times faster than the original aromatic parent molecules over the same noble metal catalyst or any other conventional hydrotreating catalyst.

In a preferred embodiment, the lighter fraction of effluent from the hydrotreating process is first separated from the heavier fraction of effluent before the heavier fraction is contacted with the hydrodearomatization catalyst. In another preferred embodiment, the $H_2S$ and $NH_3$ produced by the hydrotreating step are removed before the effluent is contacted with said hydrodearomatization catalyst. In a further preferred embodiment, the $H_2S$ and $NH_3$ are removed from the effluent, along with the lighter fraction, before the heavier fraction is contacted with the hydrodearomatization catalyst.

The support for the hydrodearomatization catalyst can be selected from the group consisting of gamma-$Al_2O_3$, zeolite beta, USY, ZSM-12, mordenite, $TiO_2$, ZSM-48, MCM-41, $SiO_2$, $ZrO_2$, $\eta$-$Al_2O_3$, $\partial$-$Al_2O_3$, SAPOs, MEAPOs, $AlPO_4$s, or a combination thereof. The noble metal catalyst of the dearomatization catalyst can be selected from the group consisting of platinum, palladium, ruthenium, rhodium, iridium, osmium, rhenium, or a combination thereof. Platinum is preferred.

In another embodiment of the invention, the method further includes contacting at least the heavy fraction of the effluent from the hydrotreating process with a hydrodesulfuriztion (HDS) catalyst. It is preferred that the hydrodesulfurization catalyst contain a base metal. Typical HDS catalysts include, but are not limited to, $CoMo/Al_2O_3$, $NiMo/Al_2O_3$, $NiW/Al_2O_3$, and $NiCoMo/Al_2O_3$.

The effluent from the hydrotreating step is contacted with the hydrodearomatization catalyst and the hydrodesulfurization which are arranged within a reaction vessel. This arrangement within the reaction vessel can consist of various schematics. One schematic is with the hydrodearomatization catalyst and the hydrodesulfurization catalyst combined in two separate layers, or in multiple alternating layers. Another is with the hydrodearomatization catalyst and the hydrodesulfurization catalyst being separate extrudates which are mixed. Another schematic is with the hydrodearomatization catalyst and the hydrodesulfurization catalyst being a single extrudate in which the noble metal of the hydrodearomatization catalyst and the metal of the hydrodesulfurization catalyst are co-incorporated. The schematic can also be any combination thereof.

Process conditions will vary based upon the properties of the effluent feed. However, the preferred operating conditions generally include a temperature of 550–800° F., a pressure of 200–1100 psig, an LHSV of 0.5–10 $hr^{-1}$, and a $H_2$ recycle rate of 300–2500 SCFB.

Thus, the present invention provides a method of removing sulfur from a hydrocarbon feed at a lower temperature and pressure, and with lower capital investment.

DETAILED DESCRIPTION OF INVENTION

Figure 1:
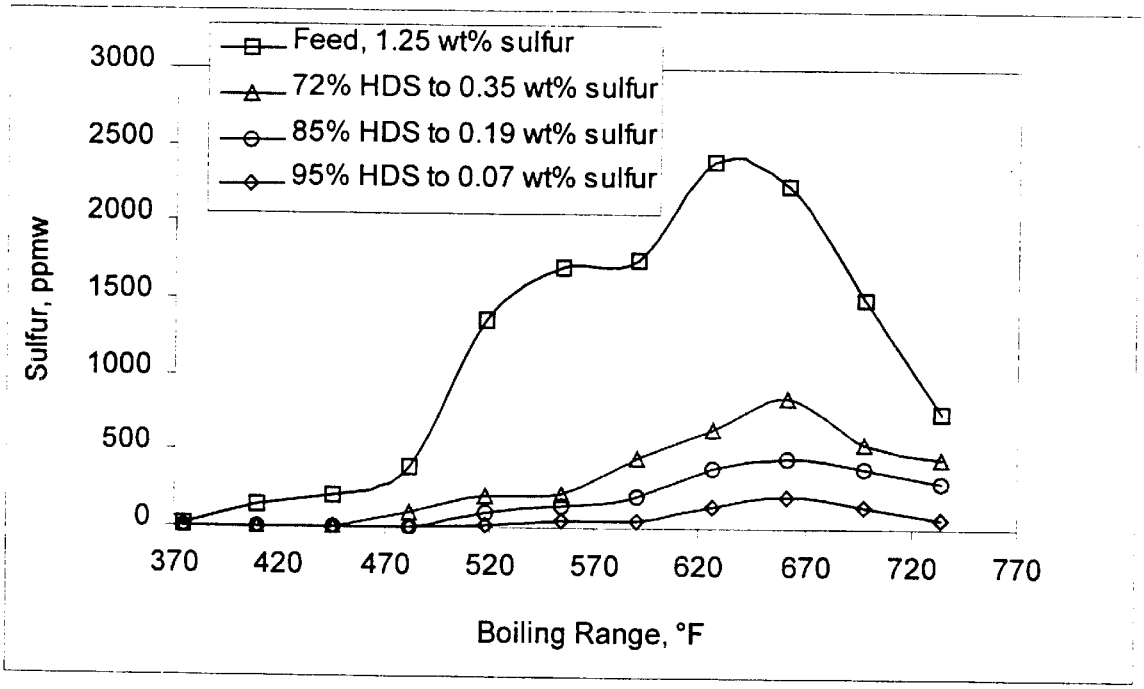
FIG. 1 is a graph demonstrating the relative concentration of sulfur compounds plotted as a function of boiling range for LGO at different hydrodesulfurization conversions.

In accordance with the present invention, a process is provided for the removal of sulfur compounds from a hydrocarbon feed. Unlike conventional desulfurization methods which rely on extreme process conditions or unique combinations of feedstock, catalyst volume, and pressure; the process of the invention relies upon the ability to process the petroleum at an increased reactor volume through the selective hydrogenation and removal of polyaromatic sulfur compounds which impede the desulfurization process.

The feedstock can generally be described as high boiling point feeds of petroleum origin. In general, the feeds will have a boiling point range of about 350° F. to about 750° F. (about 175° C. to about 400° C.), preferably about 400° F. to about 700° F. (about 205° C. to about 370° C.). Generally, the preferred feedstocks are: (a) non-thermocracked streams, such as gasoils distilled from various petroleum sources, (b) catalytically cracked stocks, including light cycle oil (LCO) and heavy cycle oil (HCO), clarified slurry oil (CSO), and (c) thermally cracked stocks such as coker gas oils, visbreaker oils or related materials, and (d) any of the above which have undergone partial hydrotreatment.

Cycle oils from catalytic cracking processes typically have a boiling range of about 400° F. to 750° F. (about 205° C. to 400° C.), although light cycle oils may have a lower end point, e.g. 600° F. or 650° F. (about 315° C. or 345° C.). Because of the high content of aromatics and poisons such as nitrogen and sulfur found in such cycle oils, they require more severe hydrotreating conditions, which can cause a loss of distillate product. Lighter feeds may also be used, e.g. about 250° F. to about 400° F. (about 120° C. to about 205° C.). However, the use of lighter feeds can result in the production of lighter distillate products, such as kerosene.

In the first step of the process, the feed is hydrotreated under conventional methods to convert nitrogen and sulfur containing compounds to gaseous ammonia and hydrogen sulfide. At this stage, hydrocracking is minimized, but partial hydrogenation of polycyclic aromatics proceeds, together with a limited degree of conversion to lower boiling (343° C., 650° F.) products. The catalyst used in this stage may be a conventional hydrotreating catalyst. Catalysts of this type are relatively immune to poisoning by the nitrogenous and sulfurous impurities in the feedstock and generally comprise a non-noble metal component supported on an amorphous, porous carrier such as silica, alumina, titania, silica-alumina or silica-magnesia. Because extensive cracking is not desired in this stage of the process, the acidic functionality of the carrier should be relatively low.

The metal component of the hydrotreating catalyst may be a single metal from Groups VIA and VIIIA of the Periodic Table such as nickel, cobalt, chromium, vanadium, molybdenum, tungsten, or a combination of metals such as nickel-molybdenum, cobalt-nickel-molybdenum, cobalt-molybdenum, nickel-tungsten or nickel-tungsten-titanium. Generally, the metal component will be selected for good hydrogen transfer activity. The catalyst as a whole will have good hydrogen transfer and minimal cracking characteristics. The catalyst should be pre-sulfided in the normal way in order to convert the metal component (usually impregnated into the carrier and converted to oxide) to the corresponding sulfide, and oxysulfide.

After desulfurization in the hydrotreating step and removal of $H_2S$ and $NH_3$, the resulting effluent contains approximately 500 ppm sulfur or less. Essentially all of the remaining sulfur containing compounds remaining in the effluent are sterically hindered dibenzothiophene (DBT) and its alkyl homologs, which are difficult to desulfurize. Table 1 demonstrates the relative reactivity of the various sulfur containing compounds that may be contained in the hydrocarbon effluent or feed.

TABLE 1

Relative Rate of Hydrodesulfurization

| Reactant | Structure | First Order Relative Rate Constant |
|---|---|---|
| Thiokol | R—SH | 5000 |
| Disulfides | RSSR | 5000 |
| Sulfides | RSR | 5000 |
| Thiophene | 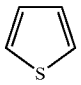 | 5000 |

TABLE 1-continued

Relative Rate of Hydrodesulfurization

| Reactant | Structure | First Order Relative Rate Constant |
|---|---|---|
| Benzothiophene | 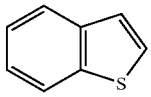 | 2900 |
| Dibenzothiophene (DBT) | 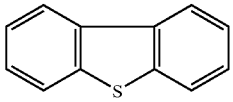 | 220 |
| 4,6-Dimethyl dibenzothiophene | 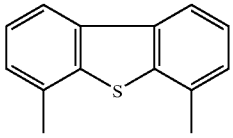 | 22 |
| 4,6-Tribenzothiophene | 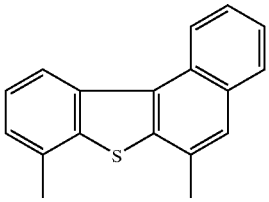 | 1100 |
| Benzonaphthothiophene | 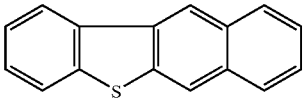 | 580 |

(a) R refers to any hydrocarbon group attached to the sulfur atom.
(b) B. C. Gates, J. R. Katzer, and G. C. A. Schuit, "Chemistry of Catalytic Processes," McGraw-Hill (1979) and H. Topsoe, B. S. Clausen, and F. E. Massoth, "Hydrotreating Catalysis: Science and Technology," Springer (1996).

As shown in Table 1, the rate of reactivity of hydrodesulfurization is low for DBT compounds, particularly 4,6-dimethyl dibenzothiophene.

Figure 2:
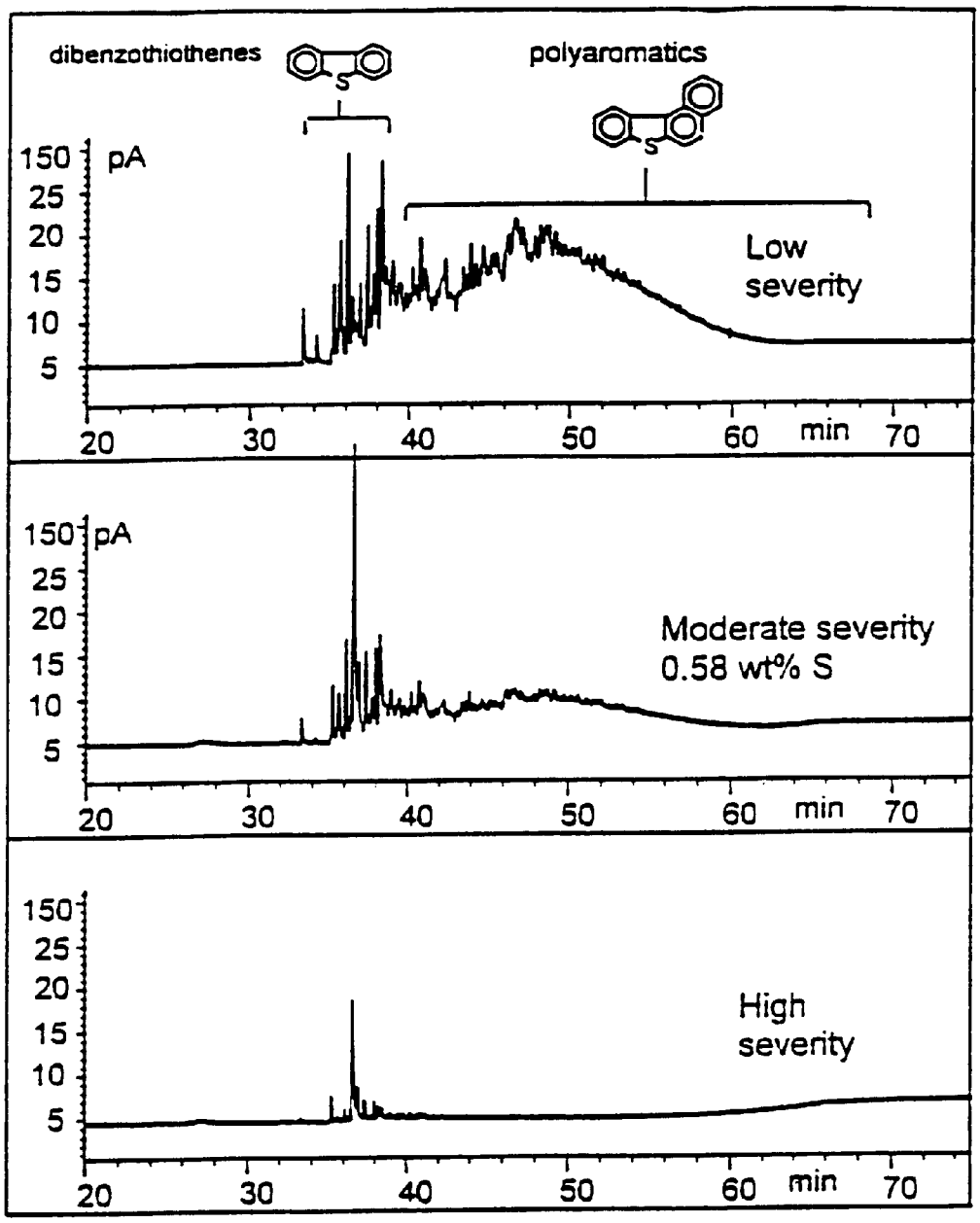
FIG. 2 is a graph demonstrating the relative percentage of sulfur compounds plotted as a function of molecular weight for different hydrodesulfurization conversions.

The boiling range of substituted and non-substituted DBT is 530–750° F. This boiling range is shown in FIG. 1. As the percent desulfurization increases, the relative percentage of DBTs increase. FIG. 2 displays the same trend for a heavier VGO feed. The higher molecular species are desulfurized more readily than the DBTs, which indicates the difficulty of desulfurizing these sterically hindered species.

To increase the rate of desulfurization of a hydrocarbon source containing the sterically hindered species, the focus must be shifted from the conventional process of direct desulfurization. The process of the invention increases the rate of desulfurization by increasing the reactivity of the polyaromatic sulfur compounds, including DBTs, remaining in the effluent after the hydrotreating step. The rate of reactivity of these compounds is increased by hydrogenating one or more of the aromatic rings, thereby shifting the reactivity upward from that of the polyaromatic sulfur compounds to that of sulfides.

Since the sulfur containing compounds remaining in the effluent after the hydrotreating mainly consists of DBTs, and DBTs have the slowest desulfurization rate, DBTs are the primary concern. The typical desulfurization reaction of 4,6-dimethyl DBT is:

(I)

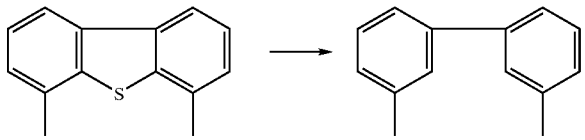

At a pressure less than 800 psig with a conventional base metal catalyst, this reaction is extremely slow. At higher pressures, e.g. 1200–2000 psig, one of the aromatic rings can be hydrogenated in the presence of a base metal catalyst as follows:

(II)

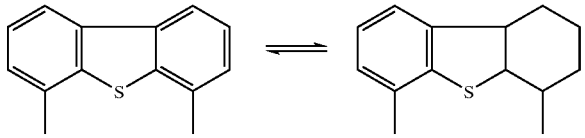

However, it is undesirable to operate at such severe pressure conditions because of the capital costs associated with the equipment. The process of the invention allows for the desired reactions to occur at much lower pressures. A process of the invention, shown in equation 3, and a conventional route, shown in equation 4, are as follows:

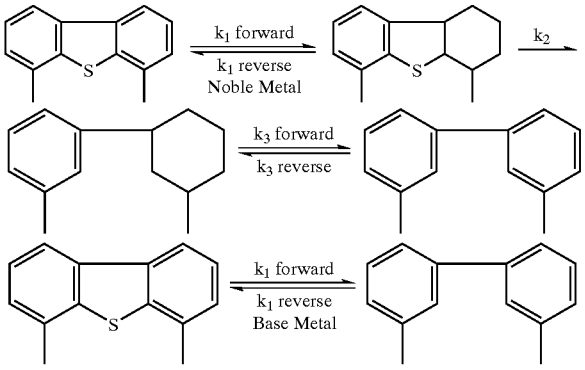

All of the rate constants of the process of the invention are approximately equal and about 250 times larger than the constant rate of the base catalyst in a conventional hydrotreating reactor.

Thus, after the hydrocarbon feed has been hydrotreated, the effluent includes a heavy fraction containing polyaromatic sulfur compounds and a lighter fraction. The effluent is contacted with a noble metal containing hydrodearomatization catalyst on a support under super-atmospheric hydrogen pressure and reaction conditions sufficient to hydrogenate at least one ring of the polyaromatic sulfur compounds, and thereby produce a product with a reduced sulfur content.

It is preferred that the hydrotreatment process be performed in a first reaction vessel and the effluent from the hydrotreatment step be contacted with the hydrodearomatization catalyst in a second reaction vessel. However, with an appropriate hydrocarbon feed and under appropriate process conditions, it is possible to have a reactor scheme where the hydrotreating catalyst and hydrodearomatization catalyst are contained within the same reactor.

In the hydrotreating stage, the nitrogen and sulfur impurities are converted to ammonia and hydrogen sulfide. At the same time, the polycyclic aromatics are partially hydrogenated to form naphthenes and hydroaromatics. It is known that ammonia and hydrogen sulfide can poison a noble metal catalyst.

Figure 3:
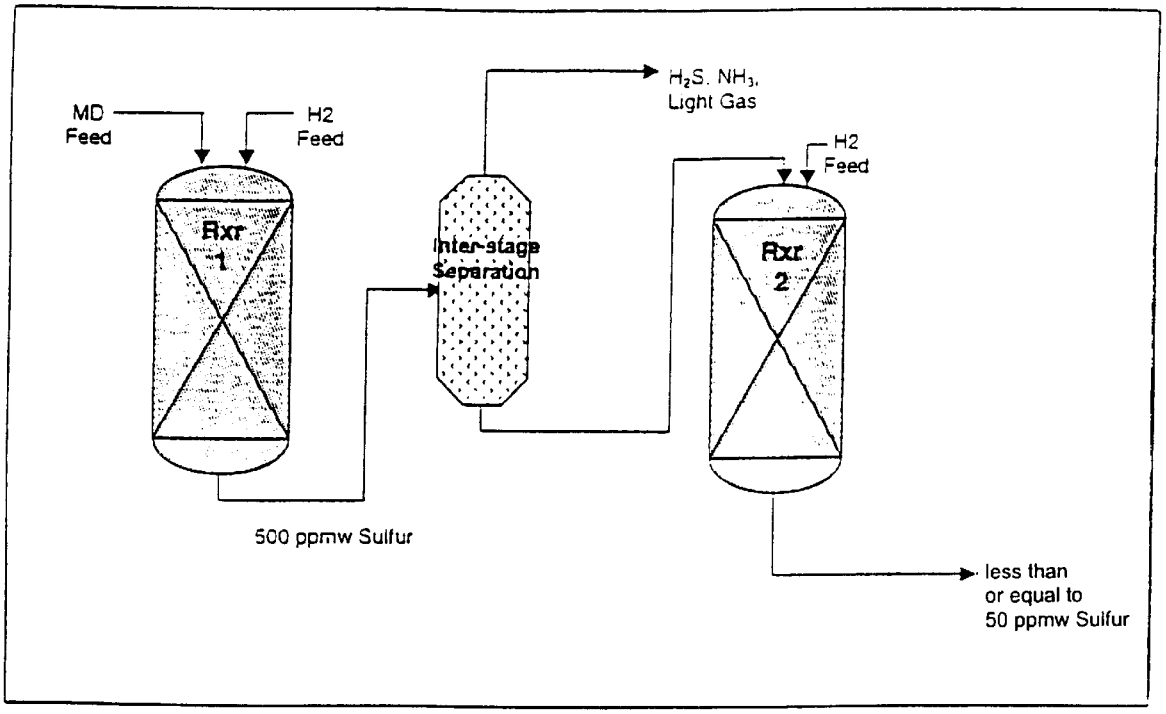
FIG. 3 is a schematic of a process configuration which includes interstage separation of $H_2S$ and $NH_3$ from the effluent after hydrotreating.

Therefore, in a preferred embodiment, the ammonia and hydrogen sulfide are removed from the effluent by a conventional interstage separation process, such as interstage stripping or distillation, before the effluent proceeds to the noble metal containing hydrodearomatization catalyst. (See FIG. 3.) The interstage separation removes $H_2S$, $NH_3$ and light gases, e.g., $C_1$–$C_4$ hydrocarbons, from the effluent before the effluent proceeds to the hydrodearomatization catalyst.

Figure 4:
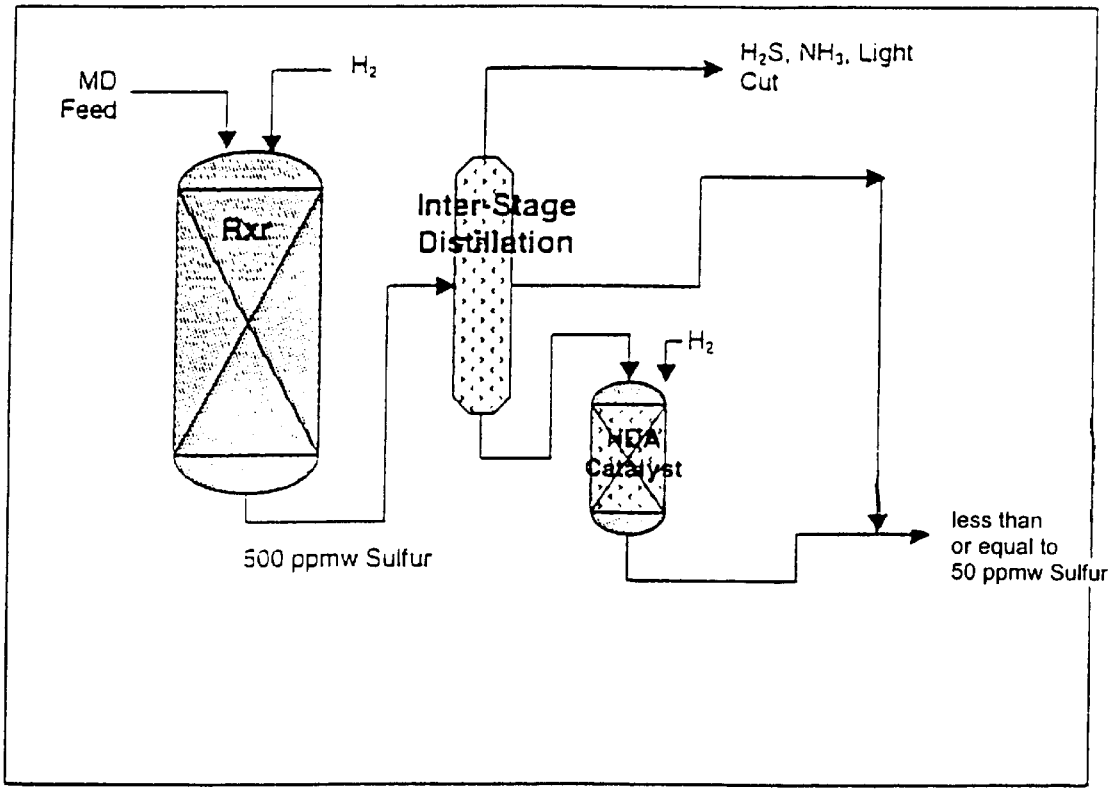
FIG. 4 is a schematic of a process configuration of the invention which includes interstage distillation.

In a separate preferred method, the $H_2S$ and $NH_3$ are separated along with a light fraction of the effluent. This separation can be performed during interstage distillation. This separation allows the high boiling point product of approximately 530–750° F. to be separately contacted with the hydrodearomatization catalyst. A schematic is shown in FIG. 4. The light fraction, i.e. effluent boiling from approximately 330–550° F., which is virtually free of sulfur, can then be recombined with the processed higher boiling range product yielding mixture containing 50 ppm sulfur or less. Because the lighter fraction of effluent is removed, the addition of a distillation column enables a much smaller second reactor to be used with more specific operating parameters when the heavier effluent is contacted with the hydrodearomatization catalyst. In the case with no interstage stripping, hydrogen quenching may be carried out in order to control the effluent temperature and to control the catalyst temperature in the hydrodearomatization stage.

The use of a noble metal hydrodearomatization catalyst allows for very controllable hydrogenation of aromatics at lower temperature or pressure conditions. Due to the easier, and hence faster, desulfurization of the partially hydrogenated polyaromatic sulfur compounds, including DBTs, the equilibrium of the hydrogenation reaction is pushed toward completion even at low pressure, where equilibrium for hydrogenation is not favored. This allows for virtually complete desulfurization, if required.

Noble metal catalysts can accomplish efficient hydrogenation. The reaction rates for hydrogenation to hydrodesulfurization is high for noble metal catalysts. The noble metal catalyst can be selected from the group consisting of platinum, palladium, ruthenium, rhodium, iridium, osmium, rhenium, platinum/palladium, or other combinations thereof. Platinum is preferred. Platinum has a relative rate constant four times greater than that of the other noble metal catalysts.

The noble metal catalyst can be supported by any known support material. Preferably, the support material is selected from the group consisting of gamma-$Al_2O_3$, zeolite beta, USY, ZSM-12, mordenite, $TiO_2$, ZSM-48, MCM-41, $SiO_2$, $ZrO_2$, $\eta$-$Al_2O_3$, $\partial$-$Al_2O_3$, SAPOs, MEAPOs, $AlPO_4$s. Zeolite catalysts are a potentially superior support because they generate a more sulfur tolerant hydrogenation function than their alumina-based counter parts. However, sensitivity to nitrogen poisoning can be higher with zeolites so support selection is strongly dependent on feed composition. Two frequently employed supports are alumina (especially the gamma phase) and amorphous $SiO_2/Al_2O_3$.

Process conditions during contact with the hydrodearomatization catalyst will vary based upon the properties of the effluent feed. However, the preferred operating conditions generally include a temperature of 550–800° F., a pressure of 200–1100 psig, an LHSV of 0.5–10 $hr^{-1}$, and a $H_2$ recycle rate of 300–2500 SCFB.

One potential limitation to using a zeolite based noble metal catalyst occurs with the operating conditions. With this type of catalyst, the temperature should remain below 600° F. Above this point, hydrocracking can occur; below this point generally hydrogenation occurs. The operating temperature can be extended above 600° F. if the zeolite acidity has been substantially reduced by conventional means, e.g. direct synthesis to very high framework $SiO_2/Al_2O_3$ ratio, hydrothermal dealumination, silicon enrichment via ammonium hexafluorosilicate, back titrations with alkali metal cations, etc.

In a preferred embodiment, the method of the invention further includes contacting at least the heavy fraction of effluent with a hydrodesulfurization catalyst. The additional bed of hydrodesulfurization catalyst can be an extra assurance that the partially saturated polyaromatic sulfur compounds will be desulfurized. The hydrodesulfurization catalyst can be conventional and will usually contain a metal, preferably a base metal.

The hydrodesulfurization catalyst can be included in the method of the invention in various schematics. The hydrodearomatization catalyst and the hydrodesulfurization catalyst will usually be contained together in a second reactor separate from the reactor containing the hydrotreating catalyst.

Figure 5:
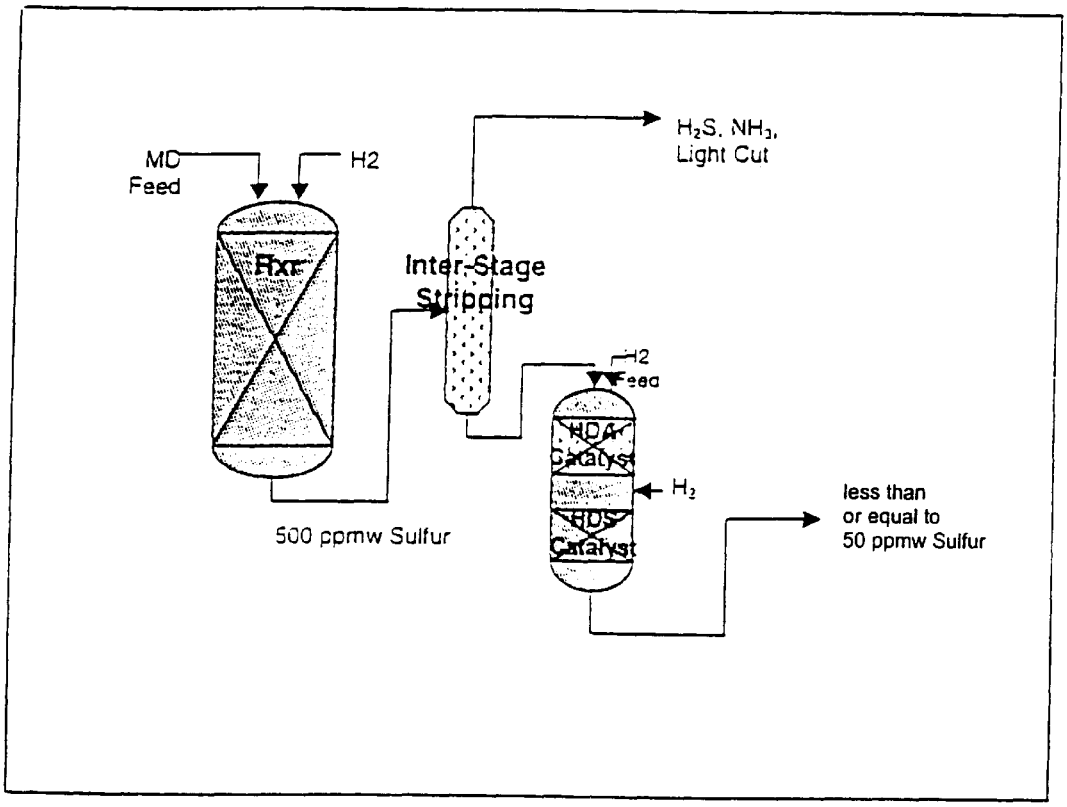
FIG. 5 is a schematic of a process configuration of the invention which includes interstage stripping and both a hydrodearomatization catalyst and a hydrodesulfurization catalyst in the second reactor.
Figure 6:
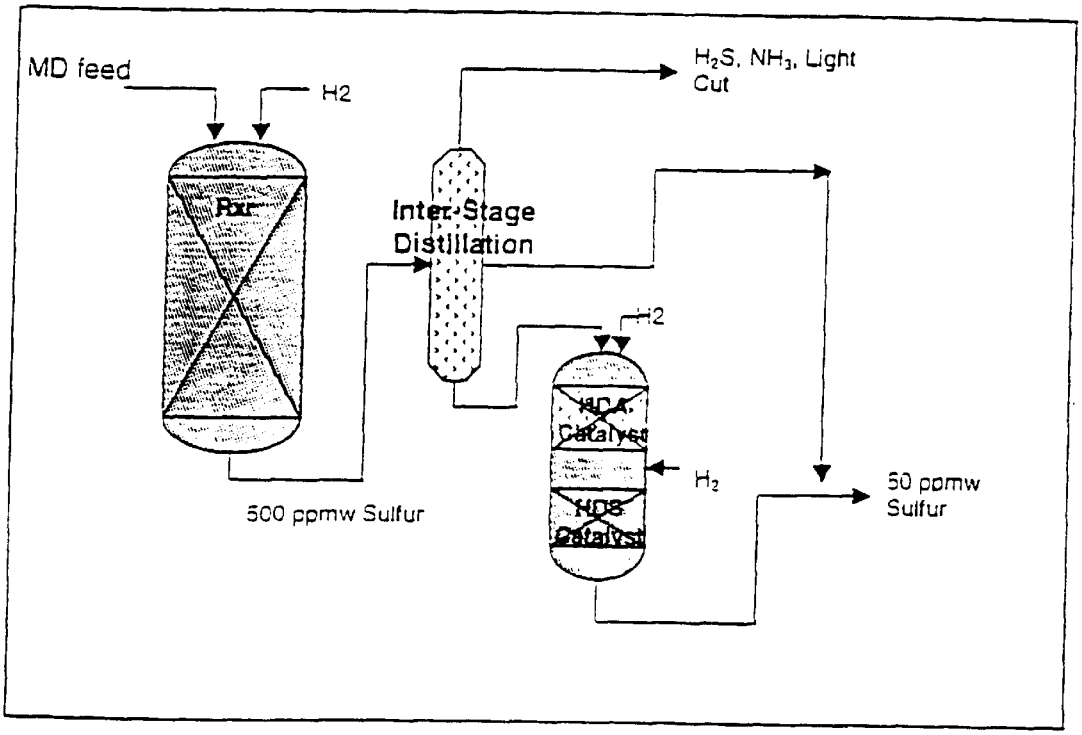
FIG. 6 is a schematic of a process configuration of the invention which includes interstage distillation and both a hydrodearomatization catalyst and a hydrodesulfurization catalyst in the second reactor.

In one schematic, the hydrodearomatization catalyst and hydrodesulfurization catalyst can be combined in two separate layers, or in multiple alternating layers. In a preferred embodiment, the effluent from the hydrotreating step can be first contacted by the hydrodearomatization catalyst, followed by the hydrodesulfurization catalyst. FIG. 5 is a schematic showing the use of both catalysts in a second reactor after interstage stripping FIG. 6 is a schematic showing the use of both catalysts after interstage distillation.

The hydrodearomatization catalyst and hydrodesulfurization catalyst can be two separate extrudes which are mixed. It is preferred that the two extrudates be of similar cross-sectional size and length. Also, the hydrodearomatization catalyst and the hydrodesulfurization catalyst can be a single extrudate in which the noble metal of the hydrodearomatization catalyst and metal(s) of the hydrodesulfurization catalyst are co-incorporated. Combinations of the schematics described are also possible.

EXAMPLE

The method of the invention was tested on two different blends of crude oil feedstocks, and their blends with LCO, CGO and VBGO. The sulfur content, the nitrogen content and the aromatic percentage are listed in Table 2 for each blend and for the cycle oil or gas oil components of each blend. Blend 1 had a sulfur content of 13000 ppm. Blend 2 had a sulfur content of 1584 ppm.

A high activity Nickel-Moly hydrotreating catalyst was employed as the first catalyst. Commercially available catalysts and suitable for this service are catalysts known as KF-840, KF-841, KF-843, KF-846 and KF-848 available from Akzo-Nobel; DN-110, DN-120, DN-140, DN-180, DN-190, DN-190+, DN-200, C-411 and C-424 available from Criterion Catalysts; HC-H, HC-K, HC-P and HC-R available from UOP; HR-346, HR-348, HR-360, HPC-50, HPC-60, HPC-312, HPC-416, HPC-40B available from AcreonCatalysts or alternately from Procatalyse or Engelhard; TK-451, TK-525, TK-551, and TK-555 available from Haldor Topsoe; CR-565, CR-535, CR-599, CR-526, and CR-522 available from Crosfield Catalysts or catalysts of similar performance available from other suppliers.

The process conditions employed were:

| | |
|---|---|
| Liquid Hourly Space Velocity, Vol./hr. Vol. | 1.7 |
| Hydrogen Circulation, SCF/B | 1000–2000 |
| Reactor Inlet Hydrogen Partial Pressure, psia | 800 |
| Weighted Average Reactor Bed Temperature, ° F. | 600–650 |

The sulfur contents are listed in Table 2 for each blend and for the cycle and gas oil components of each blend after the hydrotreating (HDT) step. Through hydrotreating the sulfur content of Blend 1 was reduced from 13000 to 299. The sulfur content of Blend 2 was reduced from 1584 to 144. The sulfur content within the blends containing LCO, CGO, and VBGO were also significantly reduced. The remaining sulfur contains mainly polyaromatic sulfur compounds, which are difficult to remove.

TABLE 2

| | Sulfur Content, ppm | | | | | | | | | |
|---|---|---|---|---|---|---|---|---|---|---|
| Feed Stocks | Blend 1 | Blend 1 + 10% LCO | Blend 1 + 20% LCO | Blend 1 + 20% CGO | Blend 1 + 20% VBGO | Blend 2 | Blend 2 + 10% LCO | Blend 2 + 20% LCO | Blend 2 2 + 20% CGO | Blend 2 2 + 20% VBGO |
| Feed | 13000 | 11700 | 10000 | 10900 | 11500 | 1584 | 1646 | 1730 | 2158 | 2360 |
| HDT | 299 | 604 | 360 | 301 | 188 | 144 | 140 | 121 | 131 | 80 |
| PtCat | 31 | 115 | 40 | 35 | 9 | 9 | 1 | 6 | 35 | 4 |

TABLE 3

| | Nitrogen Content, ppm | | | | | | | | | |
|---|---|---|---|---|---|---|---|---|---|---|
| Feed Stocks | Blend 1 | Blend 1 + 10% LCO | Blend 1 + 20% LCO | Blend 1 + 20% CGO | Blend 1 + 20% VBGO | Blend 2 | Blend 2 + 10% LCO | Blend 2 + 20% LCO | Blend 2 2 + 20% CGO | Blend 2 2 + 20% VBGO |
| Feed | 225 | 309 | 359 | 400 | 408 | 114 | 165 | 212 | 286 | 285 |
| HDT | 18 | 42 | 36 | 34 | 18 | 38 | 26 | 26 | 37 | 39 |
| PtCat | >1 | 6.4 | 2 | 2 | 1.3 | 1.4 | 10 | 1.4 | 2 | 1/4 |

TABLE 4

| | Aromatic % | | | | | | | | | |
|---|---|---|---|---|---|---|---|---|---|---|
| Feed Stocks | Blend 1 | Blend 1 + 10% LCO | Blend 1 + 20% LCO | Blend 1 + 20% CGO | Blend 1 + 20% VBGO | Blend 2 | Blend 2 + 10% LCO | Blend 2 + 20% LCO | Blend 2 2 + 20% CGO | Blend 2 2 + 20% VBGO |
| Feed | 32 | 36 | 43 | 32 | 30 | 20 | 25 | 33 | 23 | 22 |
| HDT | 27 | 35 | 40 | 27 | 25 | 22 | 57 | 33 | 23 | 21 |
| PtCat | 19 | 32 | 32 | 23 | 21 | 18 | 23 | 26 | 23 | 18 |

Figure 7:
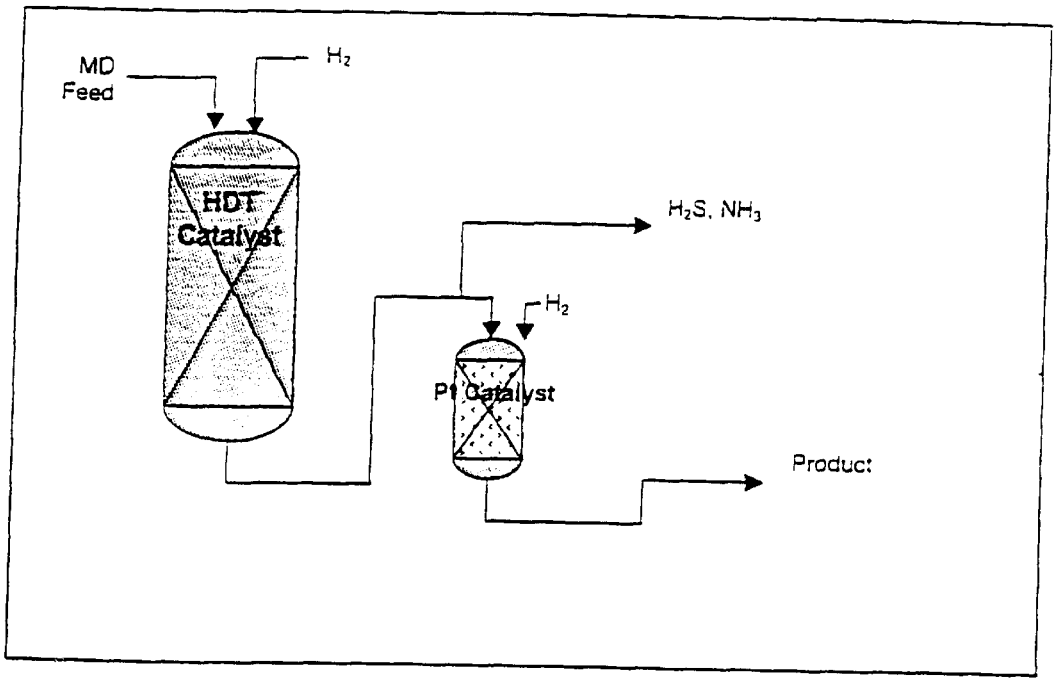
FIG. 7 is a schematic of a process configuration used in the Example which includes a platinum-containing hydrodearomatization catalyst.

The effluent from the hydrotreating step was then contacted with a hydrodearomatization catalyst. A schematic of the method is provided in FIG. 7. The hydrodearomatization catalyst consisted of platinum supported large pore zeolite.

The process conditions included a temperature of approximately 700° F. and a pressure of 400 psig. Process condi tions employed for the hydrodearomatization reaction system were:

| | |
|---|---|
| Liquid Hourly Space Velocity, Vol./hr. Vol | 1.5 |
| Hydrogen Circulation, SCF/ | 700–1500 |
| Reactor Inlet Hydrogen Partial Pressure, psia | 650 |
| Weighted Average Reactor Bed Temperature, ° F. | 660–720 |

Table 2 shows the severe desulfurization achieved by the method of the invention. Table 3 shows similar severe hydrodenitrogenation achieved in this catalyst system. After the effluent from the hydrotreating step is contacted by the hydrodearomatization catalyst, the sulfur content is reduced in Blend 1 from 299 ppm to 31 ppm. The sulfur content in Blend 2 was reduced from 144 ppm in the effluent of the hydrotreating step to 9 ppm. This shows the extraordinary ability for the method of the invention to desulfurize the effluent produced by hydrotreating a hydrocarbon feedstock, even though the sulfur containing compounds remaining in the effluent after hydrotreating are polyaromatic sulfur compounds that are normally difficult to remove. Table 4 shows total aromatics conversion/saturation, which is not necessarily required or necessary for HDS or HDS in this case. Overall aromatics saturation may be low in some cases because of unfavorable equilibrium for saturation reactions. Nonetheless, saturation of sulfur containing and nitrogen containing rings proceeds rapidly.

Thus, while there have been described what are presently believed to be the preferred embodiments of the invention, those skilled in the art will realize that changes and modifications may be made thereto without departing from the spirit of the invention, and it is intended to claim all such changes and modifications as fall within the scope of the invention.

We claim:

1. A method of removing sulfur from an effluent produced by hydrodesulfurizing a hydrocarbon feed, said effluent having a heavy fraction boiling in the range of about 530° to 750° F. containing polyaromatic sulfur compounds comprising sterically hindered dibenzothiophenes and a lighter fraction which boils in the range of about 330° to 550° F., said method comprising separating the lighter fraction of the effluent from the heavier fraction of the effluent and subjecting the heavy fraction containing the sterically hindered dibenzothiophenes to hydrodearomatization by contact with a noble metal containing hydrodearomatization catalyst on a support under super atmospheric hydrogen pressure and reaction conditions sufficient to hydrogenate at least one ring of the sterically hindered dibenzothiophenes and desulfurizing the hydrogenated polyaromatic sulfur compounds and recombining the lighter fraction with the hydrodearomatized, desulfurized fraction to produce a product with a reduced sulfur content.

2. A method according to claim 1 in which $H_2S$ and $NH_3$ produced by the hydrotreating step are removed before the heavy fraction of the effluent is contacted with the hydrodearomatization catalyst.

3. A method according to claim 1 in which the support for the hydrodearomatization catalyst comprises alumina or amorphous silica-alumina.

4. A method according to claim 1 in which the noble metal of the dearomatization catalyst comprises platinum, palladium or combinations of platinum and palladium.

5. A method according to claim 1 in which the hydrogenated polyaromatic sulfur compounds are desulfurized by hydrodesulfurization of the heavy fraction of the effluent in the presence of a hydrodesulfurization catalyst after the hydrodearomatization step.

6. A method according to claim 5 in which the hydrodesulfurization catalyst used in the hydrodesulfurization which is carried out after the hydrodearomatization step comprises a base metal hydrodesulfurization catalyst.

7. A method according to claim 1 in which the sterically hindered dibenzothiophens comprises dibenzothiophens having a first order reaction rate constant for hyrodesulfurization less than 200.

8. A method according to claim 7 in which the sterically hindered dibenzothiophenes comprises 4,6-dimethyl dibenzothiophene.

* * * * *